US005772762A

United States Patent [19]

Hanitzsch

[11] Patent Number: 5,772,762

[45] Date of Patent: Jun. 30, 1998

[54] APPARATUS FOR APPLICATION OF COATING COLOR ON A PROFILED EDGE OR ON A STRAIGHT EDGE AREA OF A WORKPIECE

[75] Inventor: Udo Hanitzsch, Bielefeld, Germany

[73] Assignee: Firma Theodor Hymmen, Bielefeld, Germany

[21] Appl. No.: 646,975

[22] Filed: May 8, 1996

[30] Foreign Application Priority Data

May 22, 1995 [DE] Germany ..... 295 08 267.4
Aug. 5, 1995 [DE] Germany ..... 295 12 660.4

[51] Int. Cl.[6] ..... B05C 1/00

[52] U.S. Cl. ..... 118/203; 118/244; 118/259; 118/261

[58] Field of Search ..... 118/203, 244, 118/259, 261; 427/428

[56] References Cited

U.S. PATENT DOCUMENTS 2,905,141 9/1959 Young ..... 118/244
3,946,700 3/1976 Cromeens ..... 118/259
4,117,800 10/1978 Maus et al. ..... 118/261
4,300,476 11/1981 Jurascheck et al. ..... 118/259

*Primary Examiner*—Laura Edwards
*Attorney, Agent, or Firm*—Henry M. Feiereisen

[57] ABSTRACT

Apparatus for application of coating color on a profiled edge or straight edge area of a workpiece, includes a motor-driven applicator roll for coating the workpiece, with the applicator roll having a diameter in the range of 200 to 300 mm for effecting a same coat texture on the narrow surfaces and on the primary surfaces of the workpiece when using a same coating material. The applicator is comprised of two structural assemblies which are connected by a quick-release coupling, with the first structural assembly being formed by a motor-and-gear unit and a mounting, and the second structural assembly being formed by the applicator roll, a plate supporting the shaft of the applicator roll, a doctor being positionally adjustable relative to the applicator roll and a pump for supplying coating color onto the applicator roll.

14 Claims, 4 Drawing Sheets

APPARATUS FOR APPLICATION OF COATING COLOR ON A PROFILED EDGE OR ON A STRAIGHT EDGE AREA OF A WORKPIECE

BACKGROUND OF THE INVENTION

The present invention refers to an apparatus for application of coating color on a profiled edge or on a straight edge area of a workpiece by means of an applicator roll which is driven by a motor and a gear unit and receives the coating color.

Conventional applicators of this type include an applicator roll of relatively small diameter of approximately 100 mm. Applicator rolls for coating primary areas are generally characterized by a relatively great diameter. As a consequence, the surface texture of coated primary surfaces differs from to the surface texture of coated edge-forming narrow surfaces when applying a same coating material. This variation of the surface texture is the result of different diameters of the utilized applicator rolls and the ensuing uneven coat transfer from the roll onto the surface being coated.

As the edges of workpieces are not always at a right angle perpendicular to the primary surface but frequently of arcuated or profiled configuration, the use of small roll diameters results in great variations of the circumferential speeds of the vertical applicator roll so that objectionable coats and waste are experienced. Moreover, the profile depth is very limited when using small rolls.

SUMMARY OF THE INVENTION

It is an object of the present invention to provide an improved apparatus for application of coating color on a profiled edge or on a straight edge area of a workpiece, obviating the afore-stated drawbacks.

In particular, it is an object of the present invention to provide an improved applicator apparatus of the above-stated type by which same coating characteristics are effected on the narrow surfaces that form the workpiece edges as on the primary surfaces.

It is still another object of the present invention to provide an improved applicator apparatus that can easily be retrofitted in a short period for coating a different workpiece.

These objects, and others which will become apparent hereinafter, are attained in accordance with the present invention by providing an applicator roll of a diameter which is in the range of 200–300 mm, preferably in the range of 230–250 mm.

The selected roll diameter corresponds to the roll diameter of rolls as utilized for coating primary surfaces. Thus, when applying same coating material, the narrow surfaces will have a same coat texture as the primary surfaces.

In accordance with another feature of the present invention, the applicator includes two structural assemblies which are connected together by a quick-release coupling, whereby the first structural assembly comprises a motor-and-gear unit and a mounting, and the second structural assembly comprises a plate for rotatably supporting the driving shaft of the applicator roll, the applicator roll itself, a doctor which is adjustable relative to the applicator roll for regulating the amount of coating material on the roll, and a pump for supplying coating color on to the applicator roll. The quick-release coupling forms a quick change system so that the applicator can be retrofitted in a short period for color coating a workpiece with different profile edge or different straight edge area.

Advantageously, the doctor of the applicator is adjustably secured relative to the applicator roll and its profiled groove for metering the amount of coating color applied on the profiled edge of the workpiece and ensuring a smooth color coating. Suitably, the doctor is formed with a projection that has a contour resembling the contour of the profiled groove of the applicator roll for engagement therein and exhibits, in plan view, a tapered end face that faces the supply of coating color. Preferably, the tapered end face of the projection is of arcuate configuration, with a radius corresponding to the radius of the applicator roll.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
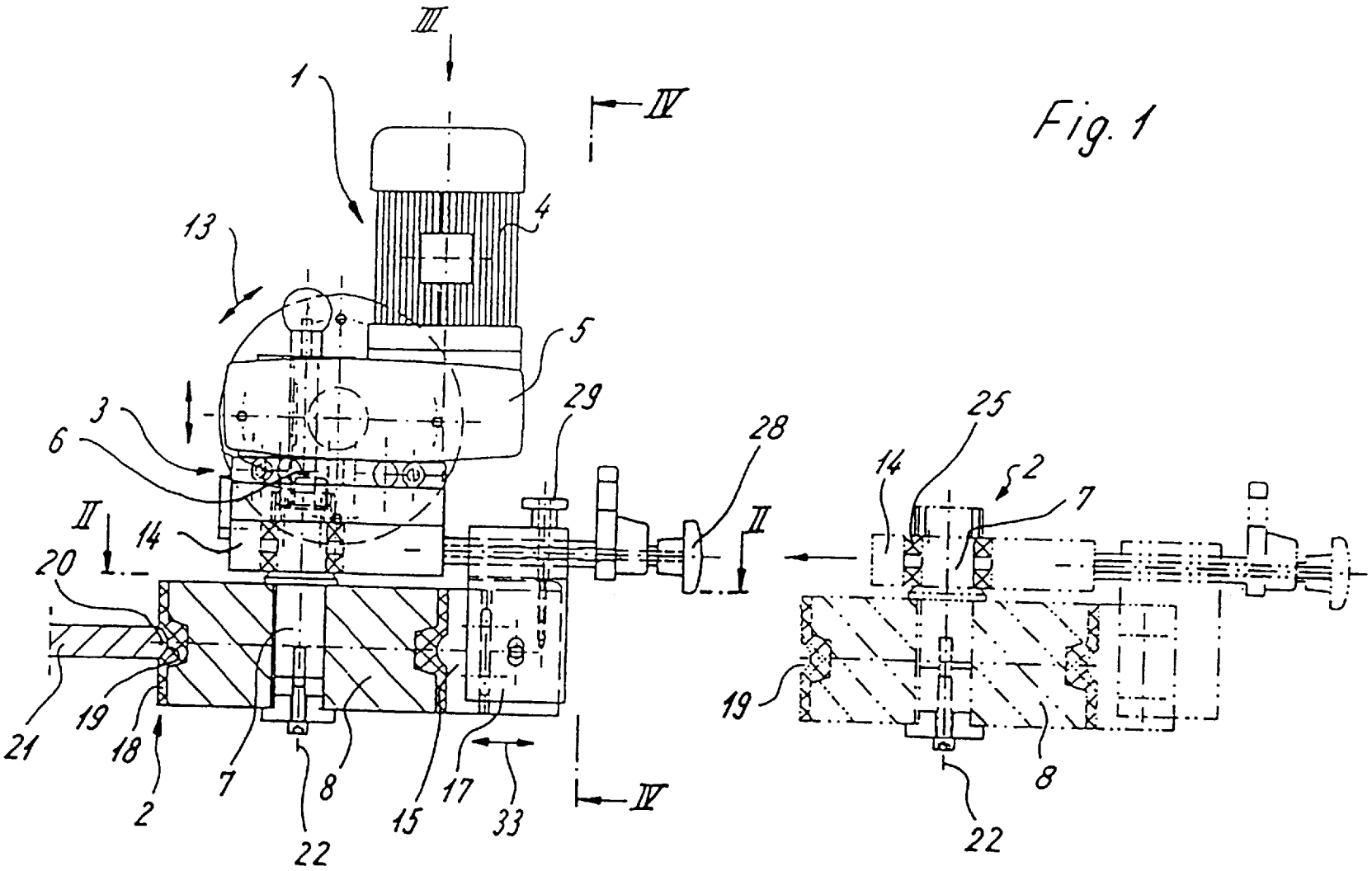
FIG. 1 is a vertical, partially sectional view of one embodiment of an applicator apparatus according to the present invention for color coating a workpiece.

Throughout all the Figures, the same or corresponding elements are always indicated by the same reference numerals.

Figure 5:
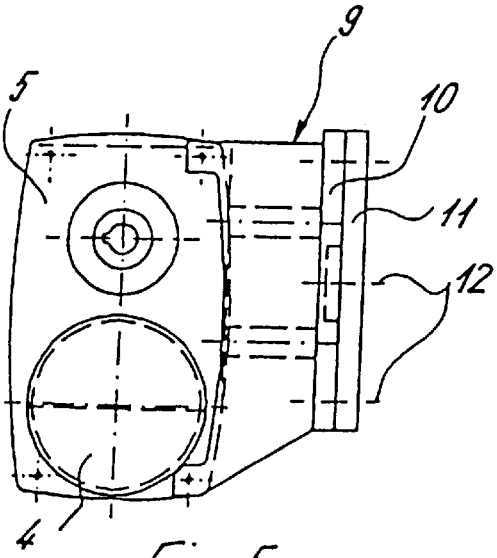
FIG. 5 is a plan view of the applicator apparatus taken in direction of arrow V in FIG. 4.

Turning now to the drawing, and in particular to FIG. 1, there is shown a vertical, partially sectional view of one embodiment of an applicator apparatus according to the present invention for application of a color coating on a workpiece 21 that exhibits a profiled edge 20. The applicator apparatus is comprised of two structural assemblies, generally designated by reference numerals 1, 2 which are joined together by a quick-release coupling 3. The structural assembly 1 includes a motor-and-gear unit comprised of electromotor 4 and transmission 5 for actuating a drive shaft 6. As shown in FIG. 5, the first structural assembly 1 further includes a mounting, generally designated by reference numeral 9 and provided with a circular perforated disk 10 which is rotatably secured to a stationary perforated disk 11 via screws 12 for thereby allowing a graduated adjustment of the first structural assembly 1 together with the coupled second structural unit 2 in direction of double arrow 13 in dependence on the selected attachment of the circular disk 10 relative to the stationary disk 11.

The second structural assembly 2 includes an applicator roll 8 which is rotatably supported on a drive shaft 7 linked to the drive shaft 6 via the quick-release coupling 3, a plate 14 for rotatably supporting the drive shaft 7 via rolling bearings 25, a doctor 15 which is retained in a holder 17 for adjustment in direction to and from the applicator roll 8, as will be described furtherbelow, and a pump 16 which is secured to the holder 17 and supplies coating color to the doctor 15 via inlet 32.

The applicator roll 8 is made preferably of metal and exhibits a jacket 18 of flexible material which is formed with a profiled groove 19 for engagement by the profiled edge 20 of the workpiece 21. For illustrative purposes, the structural assembly 2 is also shown in FIG. 1 in dashdot line to depict the disengaged disposition thereof from the structural assembly 1.

Figure 3:
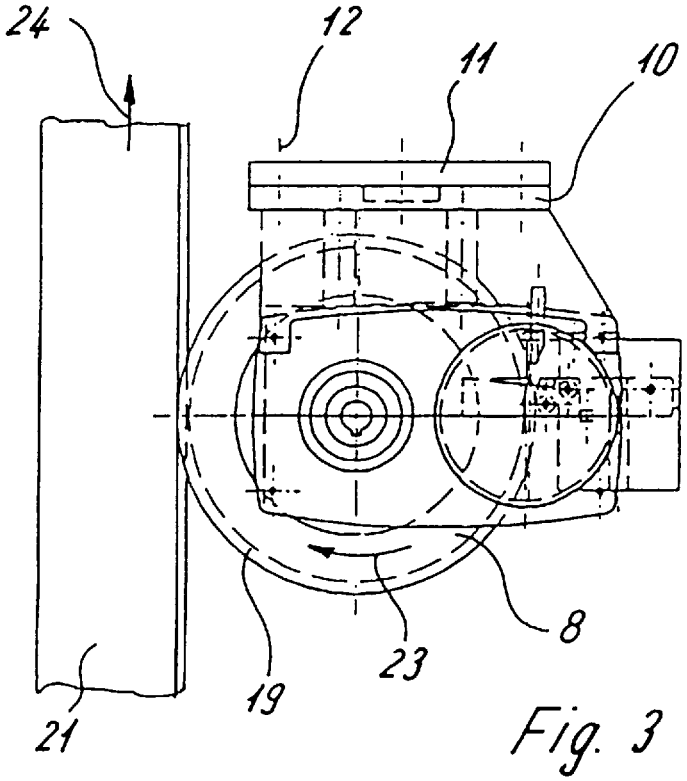
FIG. 3 is a plan view of the applicator apparatus taken in direction of arrow III in FIG. 1.

In the non-limiting example of FIG. 1, the applicator roll 8 rotates about a vertical axis 22, as indicated by arrow 23 in FIG. 3. Arrow 24 designates the traveling direction of the workpiece 21 relative to the applicator roll 8.

Figure 4:
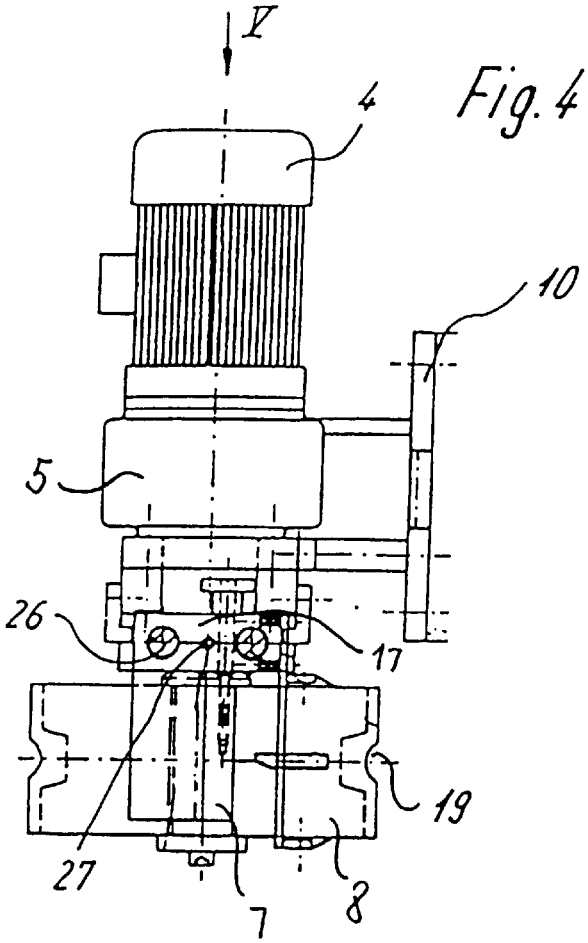
FIG. 4 is a sectional view of the applicator apparatus taken along the line IV—IV in FIG. 1.

The plate 14 is provided at the end face distant to the workpiece 21 with a guide mechanism for securing the holder 17 of the doctor 15 against rotation. As shown in particular in FIG. 4, this guide mechanism is formed by two spaced rods 26 which extend through bores of the holder 17. Placed between the rods 26 is an adjusting spindle 27 which is in mesh with a threaded bore of the holder 17 and is rotatably supported in the plate 14. At its terminal end distant to the plate 14, the adjusting spindle 27 is formed with a knob 28 for allowing manual adjustment of the spindle 27 so that the holder 17 and thus the doctor 15 are shiftable in a direction transversely to the rotational axis 22 of the applicator roll 8, as indicated by arrow 33 in FIG. 1. In addition, the doctor 15 is adjustable in a direction parallel to the rotational axis 22 by means of an adjusting screw 29 which is in mesh with a threaded bore 30 formed within the doctor 15 and extending in parallel relationship to the rotational axis 22.

Figure 7:
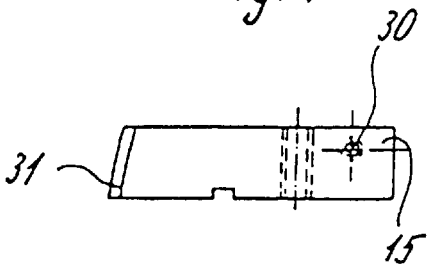
FIG. 7 is a plan view of the doctor of FIG. 6.
Figure 6:
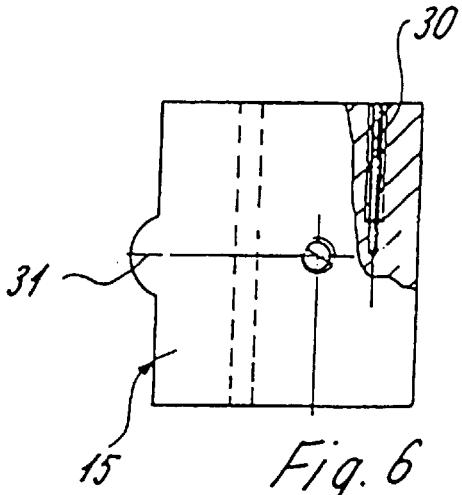
FIG. 6 is a vertical section of a doctor for use with the applicator apparatus.

As best seen in FIGS. 6 and 7, the doctor 15 is formed with a projection 31 which has a configuration resembling the contour of the profiled groove 19 of the applicator roll 8. At the side pointing toward the coating color supply, the projection 31 is of tapered configuration, with the tapered end face being shaped of arcuate configuration, as best shown in FIG. 7. Preferably, the radius of the arcuate tapered end face corresponds to the radius of the applicator roll 8, and the height of the doctor 15 substantially corresponds to the height of the applicator roll 8.

Figure 2:
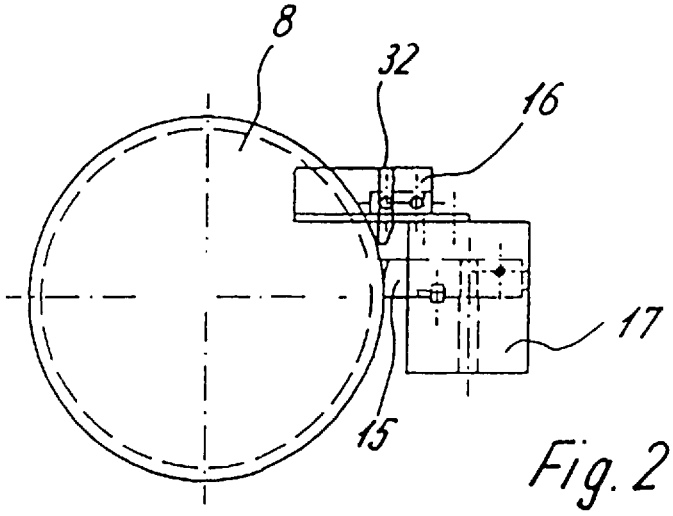
FIG. 2 is a sectional view of the applicator apparatus, taken along the line II—II in FIG. 1.

As the doctor 15 is adjustable in two directions, i.e. transversely to the rotational axis 22 as well as parallel to the rotational axis 22, the gap between the projection 31 and the profiled groove 19 of the applicator roll 8 can be adjusted very accurately so that a uniform coat of color on the profiled edge 20 of the workpiece 21 is applied. The coating color is supplied to the doctor 15 by the pump 16, preferably a diaphragm pump, through inlet 32 (FIG. 2).

Figure 8:
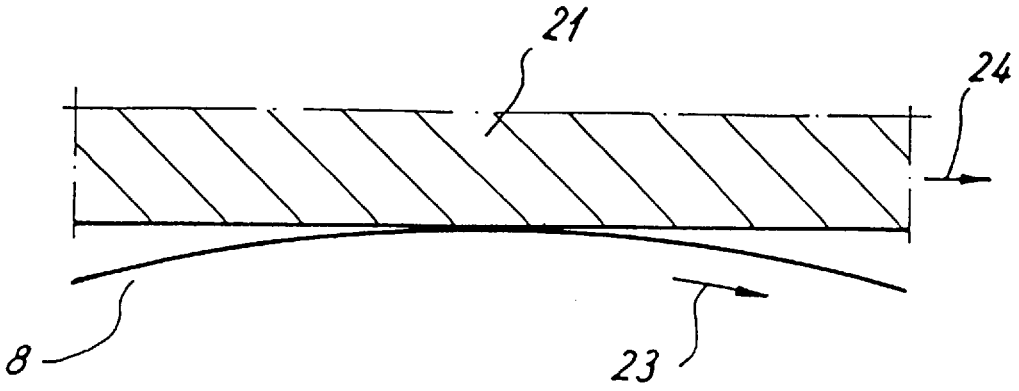
FIG. 8 illustrates an enlarged view of a portion of the workpiece in the area of the applicator roll.

As can be seen from FIG. 8, the applicator roll 8 exhibits a relatively great diameter which is selected in the range of 200–300 mm, preferably in the range of 230–250 mm so that the transfer of color coat (lacqeur, varnish) from the surface of the applicator roll 8 onto the narrow surface of the workpiece 21 is effected in a careful manner without experiencing a sudden break. As its diameter is in the range of 200–300 mm, the applicator roll 8 is also usable for coating primary surfaces so that a same coating material can be applied for coating narrow surfaces as well as primary surfaces to effect a same surface texture.

While the invention has been illustrated and described as embodied in an apparatus for application of coating color on a profiled edge or on a straight edge area of a workpiece, it is not intended to be limited to the details shown since various modifications and structural changes may be made without departing in any way from the spirit of the present invention.

What is claimed as new and desired to be protected by Letters Patent is set forth in the appended claims:

1. Apparatus for application of coating color on a profiled edge or straight edge area of a workpiece, comprising:

a motor-driven applicator roll supported on a shaft for rotation about a rotational axis for coating a workpiece;

first and second structural assemblies; and a quick-release coupling for connecting the first and second structural assemblies to each other, said first structural assembly including a motor-and-gear unit and a mounting, and said second structural assembly including the applicator roll, a plate supporting the shaft of the applicator roll, a doctor being positionally adjustable relative to the applicator roll, and a pump for supplying coating color onto the applicator roll.

2. The apparatus of claim 1 wherein the applicator roll has a diameter in the range of 200 to 300 mm.

3. The apparatus of claim 2 wherein the applicator roll has a diameter in the range of 230 to 250 mm.

4. The apparatus of claim 1 wherein the applicator roll is formed with a circumferential profiled groove for receiving a profiled edge of the workpiece, said doctor engaging the profiled groove for applying coating color supplied by the pump into the profiled groove.

5. The apparatus of claim 4 wherein the doctor is formed with a projection for engagement in the profiled groove of the applicator roll, said projection having a contour resembling a contour of the profiled groove and, in plan view, having a tapered end face in direction toward the supply of coating color.

6. The apparatus of claim 5 wherein the tapered end face of the projection is of arcuate configuration.

7. The apparatus of claim 6 wherein the applicator roll is defined by a radius, said arcuate tapered end face exhibiting a radius which corresponds to the radius of the applicator roll.

8. The apparatus of claim 1 wherein the second structural assembly includes a holder for retaining the doctor, and further comprising a guiding means positioned at a workpiece-distant end face of the plate for securing the holder against rotation, and first adjusting means secured in the plate for displacing the holder transversely to the rotational axis of the applicator roll.

9. The apparatus of claim 8 wherein the guiding means is formed by two rods spaced from each other and extending through bores of the holder, said first adjusting means including an adjusting spindle rotatably supported in the plate and extending between the rods within a threaded bore of the holder.

10. The apparatus of claim 8 wherein the doctor is adjustable transversely to the rotational axis of the applicator roll, and further comprising second adjusting means for displacing the doctor parallel to the rotational axis of the applicator roll.

11. The apparatus of claim 10 wherein the second adjusting means includes an adjusting screw in parallel relationship to the rotational axis of the applicator roll, said adjusting screw being received in a threaded bore of the doctor and exhibiting a head bearing upon the holder.

12. The apparatus of claim 1 wherein the applicator roll exhibits a height, said doctor having a height substantially corresponding to the height of the applicator roll.

13. The apparatus of claim 1 wherein the pump is a diaphragm pump secured to the holder for supply of coating color.

14. The apparatus of claim 1 wherein the mounting of the first structural assembly includes a circular disk which is rotatably secured to a stationary disk for allowing a positional adjustment of the first and second structural assemblies.

* * * * *